US006672261B1

(12) United States Patent
Svensson

(10) Patent No.: US 6,672,261 B1
(45) Date of Patent: Jan. 6, 2004

(54) APPARATUS FOR PISTON COOLING AND A METHOD FOR PRODUCING A NOZZLE FOR SUCH AN APPARATUS

(75) Inventor: Jens Svensson, Johanneshov (SE)

(73) Assignee: Scania CV AB (Publ) (SE)

( * ) Notice: Subject to any disclaimer, the term of this patent is extended or adjusted under 35 U.S.C. 154(b) by 0 days.

(21) Appl. No.: 10/069,468

(22) PCT Filed: Aug. 22, 2000

(86) PCT No.: PCT/SE00/01595

§ 371 (c)(1),
(2), (4) Date: Feb. 22, 2002

(87) PCT Pub. No.: WO01/14699

PCT Pub. Date: Mar. 1, 2001

(30) Foreign Application Priority Data

Aug. 23, 1999 (SE) ..... 9902968

(51) Int. Cl.[7] ..... F01P 3/08
(52) U.S. Cl. ..... 123/41.35
(58) Field of Search ..... 123/41.34, 41.35, 123/41.36, 41.39, 41.42, 193.6

(56) References Cited

U.S. PATENT DOCUMENTS

| | | | | |
|---|---|---|---|---|
| 4,067,307 A | | 1/1978 | Hofle et al. | 123/41.35 |
| 4,408,575 A | | 10/1983 | Clairmont, Jr. et al. | 123/41.35 |
| 5,029,759 A | * | 7/1991 | Weber | 239/533.12 |
| 5,881,684 A | * | 3/1999 | Bontaz | 123/41.35 |
| 6,029,913 A | * | 2/2000 | Stroia et al. | 239/533.12 |

FOREIGN PATENT DOCUMENTS

| | | |
|---|---|---|
| DE | 3125835 | 1/1983 |
| EP | 0825335 | 2/1998 |

* cited by examiner

*Primary Examiner*—Henry C. Yuen
*Assistant Examiner*—Hyder Ali
(74) *Attorney, Agent, or Firm*—Ostrolenk, Faber, Gerb & Soffen, LLP

(57) ABSTRACT

An arrangement for cooling a piston in a combustion engine of piston and cylinder type with a nozzle installed in a crankcase in order to spray cooling oil towards the underside of the piston including devices for supplying oil to the nozzle. The outlet end of the nozzle exhibits an elongate curved and preferably substantially U-shaped or C-shaped outlet aperture cross-section.

10 Claims, 3 Drawing Sheets

APPARATUS FOR PISTON COOLING AND A METHOD FOR PRODUCING A NOZZLE FOR SUCH AN APPARATUS

BACKGROUND OF THE INVENTION

The present invention relates to an arrangement for cooling a piston in a combustion engine by spraying cooling oil and particularly to the spray nozzle and to a method of forming the nozzle.

Arrangements for piston cooling in combustion engines are known whereby a lubricating oil flow is sprayed against the piston underside with the cooling purpose of preventing piston overheating. It is desirable to try to achieve as great a cooling oil flow as possible in order to bring about a corresponding large cooling effect at a given maximum pump output. The lubricating oil supply to the spray nozzle is normally provided by the engine's ordinary lubricating oil pump, resulting in maximum pump output at high engine speed.

However, the nozzles hitherto used have resulted, at least at the maximum distance between the nozzle and the piston, in a considerable proportion of the cooling oil flow not entering the piston cooling ducts, thereby leading to low efficiency and relatively limited cooling effect. A large proportion of the oil has also been pumped round unnecessarily, leading to undesirable losses. One problem in this context is that a more comprehensive and intensive jet results in premature fragmentation of the jet, i.e. it deviates greatly from the desired, usually circular cylindrical, shape and assumes instead a conical and progressively spreading shape. The consequences include poorer directional accuracy and inferior effectiveness.

U.S. Pat. No. 4,408,575 describes an attempt to solve this problem by means of a main jet at a first velocity which is surrounded by a multiplicity of smaller jets at lower velocity. However, the solution presented in that document involves a complicated nozzle which is expensive to produce and install. A moderate spray effect may also be expected. The use of small holes also entails a large risk of obstruction. All this makes the nozzle unit proposed in that document both economically and technically disadvantageous.

OBJECTS AND MOST IMPORTANT CHARACTERISTICS OF THE INVENTION

One object of the present invention is to provide an arrangement of the kind mentioned in the introduction which eliminates the problems of the state of the art.

This object is achieved by the outlet end of the nozzle exhibiting an outlet aperture in the form, as seen in one cross-section, of a curved slit. This produces very good flow characteristics by preventing fragmentation of the jet. Instead, the whole jet stays largely concentrated for a long distance, even at high pump pressure, resulting in better cooling oil utilization in that a larger proportion of the cooling oil reaches the intended part of the piston and can exert there its cooling effect. This is particularly important in the case of engines with long piston strokes entailing long spraying distances, and at high pump outputs at which the jets delivered by nozzles according to the state of the art usually become prematurely fragmented.

The nozzle preferably consists of an integrated pipe section, which is easy to produce. A standard component may be used as the tube blank.

The outlet aperture preferably has a U-shaped or C-shaped cross-section so that the form of the aperture is "almost circular", resulting not only in good anti-fragmentation characteristics but also in such a nozzle being economically advantageous and technically uncomplicated to produce.

Producing the nozzle by plastic forming about a mandrel which defines the shape of the outlet aperture and is preferred in connection with the invention enables the nozzle to be manufactured easily and economically and in a reliable manner. The invention also relates to a rational method for producing a nozzle for use in connection with the invention, whereby a tube blank is shaped plastically so that the resulting nozzle's outlet aperture has a curved slit shape and preferably a U or C shape.

Further advantages are achieved by other aspects of the invention and are indicated below.

BRIEF DESCRIPTION OF THE DRAWINGS

The invention will now be described in more detail on the basis of embodiments and with reference to the attached drawings, in which.

DESCRIPTION OF EMBODIMENTS

Figure 1:
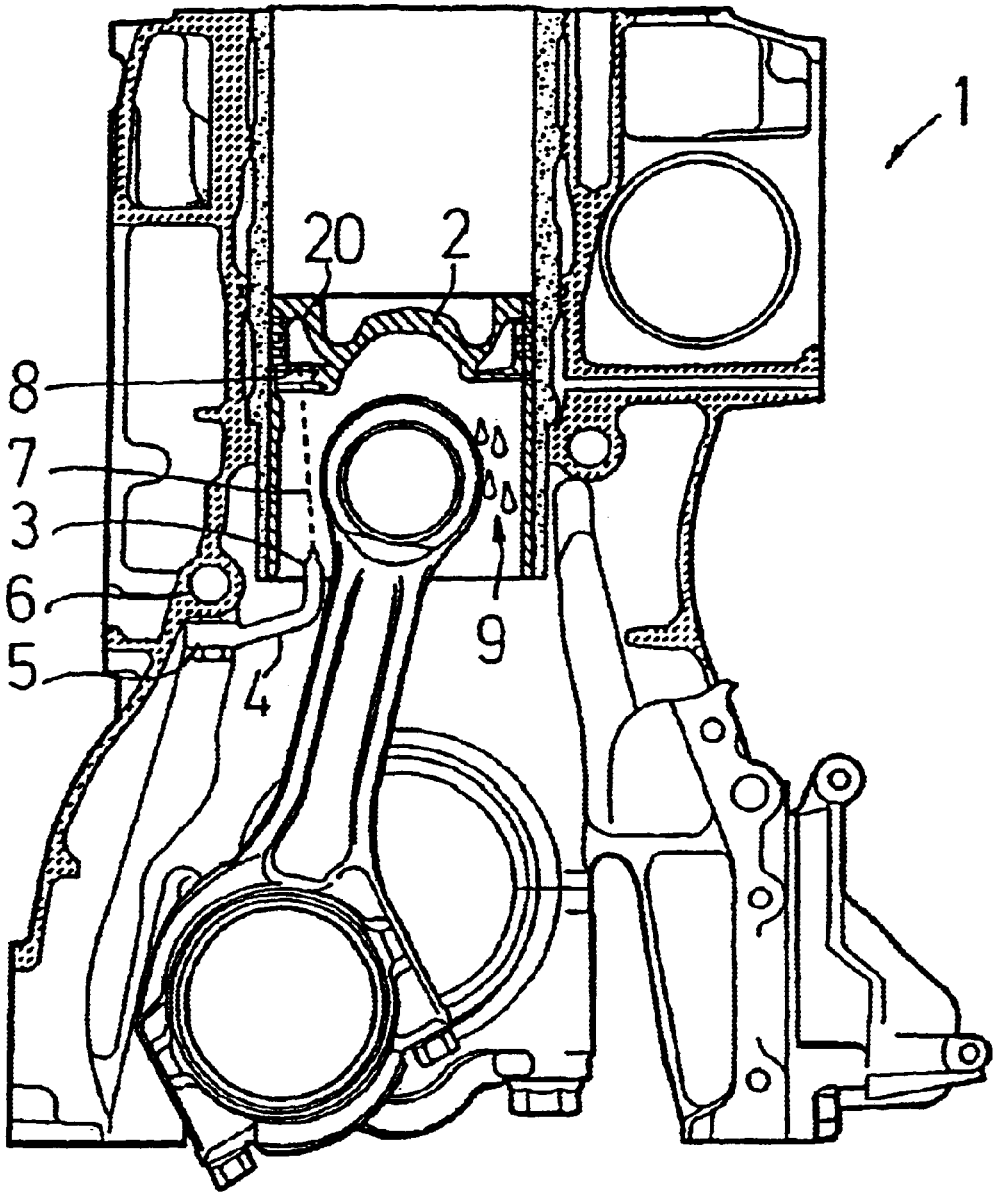
FIG. 1 depicts a cross-section through a combustion engine provided with an arrangement according to the invention.
Figure 3A:
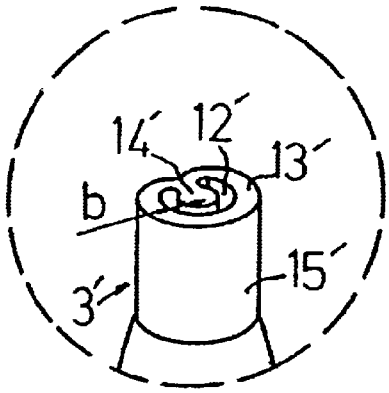
FIG. 3A is an enlarged description of an outlet according to a second embodiment, and FIG. 4 schematically illustrates elements used in steps in the process of the invention.

In FIG. 1, reference 1 denotes generally a section through a combustion engine of piston and cylinder type with a working piston 2 which is usually movable upwards and downwards in a working space (cylinder). The engine may, for example, consist of a multi-cylinder diesel engine intended as the drive engine in a vehicle. All the cylinders of the engine are provided with cooling arrangements according to the invention, but as they are all of similar design the remainder of the description will only be concerned with the arrangement in one of the engine's cylinders. Beneath the piston 2, a nozzle 3 is installed to spray cooling lubricating oil towards a cooling jacket 20 incorporated in the piston 2. The spray is injected via an inlet bole 8 which is situated in the underside of the jacket and which may be arranged in a separate cover plate but may also be arranged in a number of other ways.

The nozzle 3 consists of the integrated free end of a pipe section 4 which is firmly accommodated in the material of the crankcase wall by means of a pipe bend and a fastening arrangement 5 and which communicates in a conventional manner with an oil duct 6 which is fed by an undepicted device such as usually the engine's normal lubricating oil pump. Reference 7 denotes a jet of oil emanating from the nozzle 3 and directed so that, whatever the position of the piston, the jet enters the inlet hole 8 and flows through the piston's cooling jacket 20 in order to absorb thermal energy from the piston. It is desirable that the cooling takes place as close as possible to the top of the piston, which naturally means that the lubricating oil has to travel a long distance.

Reference 9 denotes the return flow of cooling oil from the cooling jacket, consisting of heated oil which leaves the cooling jacket via some other (undepicted) hole in order thereafter to return in a conventional manner to the engine's ordinary lubricating system.

Figure 2A:
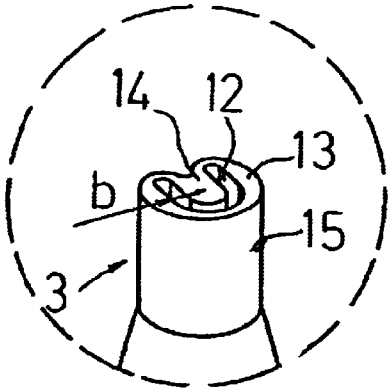
FIG. 2A is an enlarged depiction of an outlet according to a first embodiment.
Figure 2:
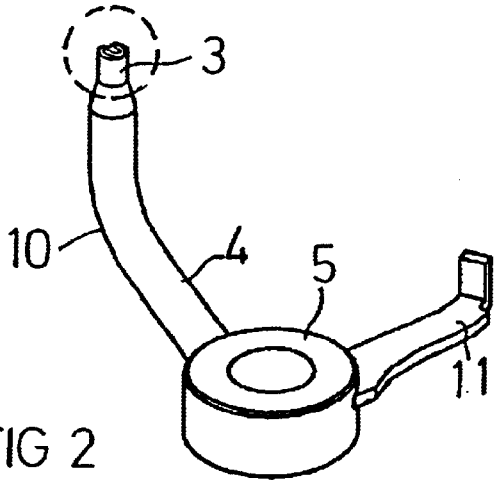
FIG. 2 depicts an arrangement according to the invention in perspective.

FIG. 2 indicates in more detail the design of the nozzle 3, which in this case is installed on a rectilinear portion of the pipe section 4, which is directed towards the inlet hole 8 (FIG. 1). The remainder of the pipe section, with its other end, is fastened in the fastening device 5, which is itself secured as depicted in FIG. 1.

When being fitted, the arrangement is oriented by means of a conventional orienting arm 11 for correct orientation of the nozzle. The magnified depiction of the nozzle 3 at the top of FIG. 2 shows more clearly the design of its outlet aperture 12, which in this case has a U-shaped cross-section and a relatively small width b compared to the total developed length of the curved aperture. This aperture might be characterised as a curved aperture slit. The length of pipe wall which corresponds approximately to the cylindrical outer shell surface 15 of the pipe section 4 is provided with substantially the same cross-section, which means that the flow of oil pushed through the nozzle has time to become established enough to prevent undesirable turbulence. The outlet aperture 12 is delineated by an outer delineating wall 13 and an inner delineating wall 14 as a result of plastic forming of a tube with the same dimension as the main extent of the depicted pipe section 4.

The plastic forming process is thus performed, according to one aspect of the invention, by inserting in the pipe section a mandrel whose cross-section corresponds to the desired outlet aperture 12, and when the process has been completed, preferably by rolling pressing by means of a tool with successively insertable press rollers, any necessary final treatment of the nozzle is carried out, e.g. by final grinding of the end surface delineating the nozzle.

Figure 3:
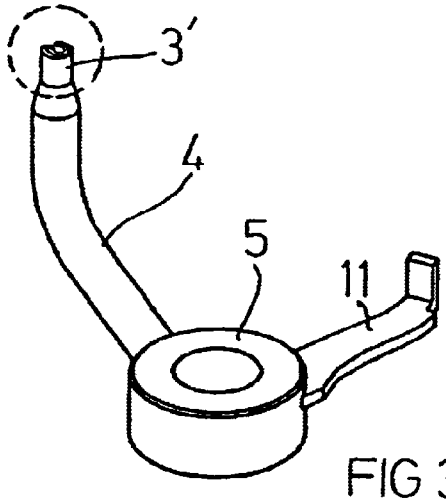
FIG. 3 is similar to FIG. 2 but depicts a second embodiment of the invention.

The only difference between the embodiment depicted in FIG. 3 and that in FIG. 2 is the cross-section of the outlet aperture 12', which in this case is substantially C-shaped, the major portion of it consisting of a substantially circular annular aperture. In FIG. 3, reference 3' denotes the nozzle, 15' the substantially cylindrical shell surface, 13' the outer delineation of the aperture and 14' its inner delineation. Reference b' denotes the width of the curved "aperture slit".

The invention may be varied within the scope of the claims with nozzle arrangements which are differently designed and produced. Thus the pipe section may be of a different design and the nozzle may be produced in a different way, by some other conventional kind of metal processing or forming, although the aforesaid plastic forming process is preferred. The nozzle may also be made as a separate element fastened to the pipe. It is nevertheless essential that the aperture slit be curved, preferably to a U or C shape, which has been found to cause the jet emanating from such a nozzle to stay together for a long distance without becoming fragmented, even at high pump outputs. One explanation of this is that as expansion of the jet is allowed "inwards", towards the center of the curved cross-section, forces acting to broaden the jet are reduced.

Experiments have shown a correct targeting rate of about 90% for an arrangement according to the invention with a substantially C-shaped outlet aperture cross-section, as against about 60% for an ordinary known nozzle with circular cross-section and corresponding nozzle area and with other parameters the same. These values refer to the top dead center position of the piston when the latter is at its maximum distance from the nozzle. This indicates that the invention causes a greater piston cooling effect while at the same time reducing the energy consumption required for achieving the piston cooling flow.

Figure 4:
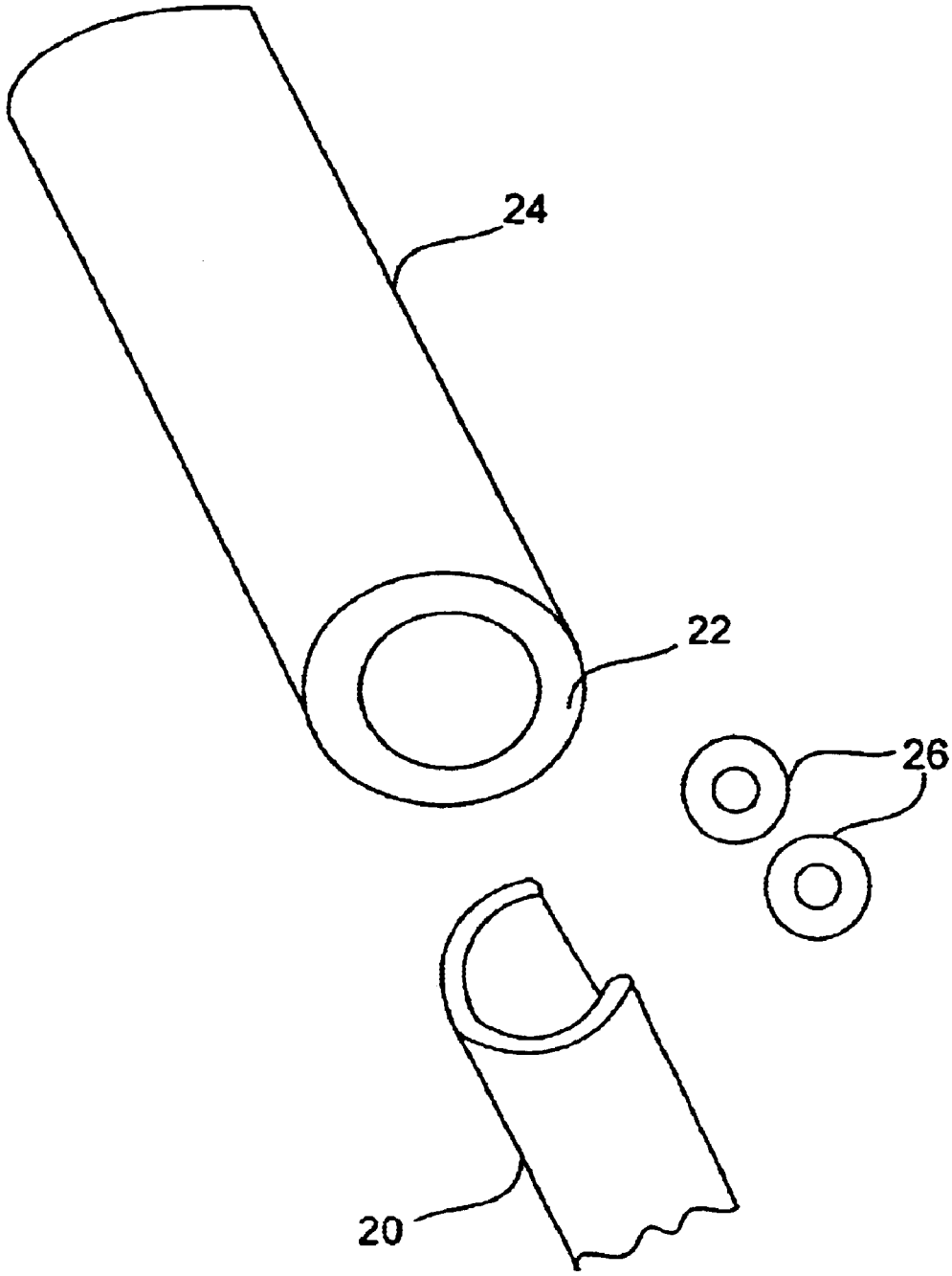

A method for producing a nozzle for spraying cooling oil towards the underside of a piston for a combustion engine as shown in FIG. 4 involves inserting a mandrel 20 which exhibits a desired cross-section, preferably a substantially U-shaped or C-shaped cross-section, into one end 22 of a blank 24 consisting of a metal pipe section, which end is intended to become the outlet end of the nozzle. Thereafter the pipe walls are pressed against the mandrel 20 to bring it about, by a plastic forming process, that the nozzle assumes an internal cross-section corresponding to the cross-section of the mandrel, as in FIG. 2. A subsequent stage is the extraction of the mandrel from the pipe section. The result is the formation of two pipe wall portions which respectively constitute the inner and outer delineating walls of the nozzle's outlet aperture. This is followed by any final treatment of the nozzle required for achieving an appropriate finish, e.g. grinding of the nozzle's end surface. In many cases there is no need for any such final process and the nozzle is usable immediately after the plastic forming process.

The pipe walls are preferably pressed against the mandrel by rolling pressing as at 26.

What is claimed is:

1. An arrangement for cooling a piston in a combustion engine, wherein the engine includes a cylinder, a piston disposed in the cylinder and the piston being operable to reciprocate in the cylinder, the piston having a top side and an opposite underside in the cylinder;

a conduit for supplying oil, the conduit having an oil outlet nozzle disposed in the cylinder and directed toward the underside of the piston, the nozzle having an outlet aperture which opens in the direction toward the underside of the piston, and the outlet aperture has the shape of an outlet slit which is curved in a cross section across the nozzle.

2. The arrangement of claim 1, wherein the conduit for supply of oil includes a pipe with an outlet end on which the nozzle is disposed.

3. The arrangement of claim 2, further comprising a fastening portion on the pipe which is fastened to the cylinder for supporting the pipe and nozzle.

4. The arrangement of claim 1, wherein the cross-section of the outlet aperture for the oil is substantially U-shaped.

5. The arrangement of claim 1, wherein the cross-section of the outlet aperture for the oil is substantially C-shaped.

6. The arrangement of claim 1, further comprising a cooling jacket around the piston beneath the top side thereof, the jacket having an underside facing the underside of the piston, an inlet into the underside of the jacket and the nozzle being directed to spray cooling oil into the inlet to the jacket on the piston.

7. The arrangement of claim 6, wherein the jacket further includes an outlet from the jacket for oil enabling return of the sprayed oil out of the jacket.

8. The arrangement of claim 1, wherein the aperture of the nozzle is formed by the process of forming an end of a pipe about a mandrel for defining a shaped outlet aperture by reshaping the open end of the pipe such that the pipe develops at the outlet a first pipe wall portion forming an inner portion of a curved cross section and another pipe wall portion defining an outer portion of a curved cross section, for defining the nozzle outlet aperture between the inner and the outer pipe wall portions.

9. The arrangement of claim 1, wherein the outlet nozzle includes an inner wall portion partially surrounded by the outlet slit and an outer wall portion around the outside of the outlet slit, the inner and outer wall portions being joined together to define the outlet slit for delineating the outlet aperture from the nozzle.

10. The arrangement of claim 3, wherein the pipe is curved, the pipe having a first part having the outlet aperture therein, the first part of the pipe being oriented so that the outlet aperture is directed toward the underside of the piston;

the pipe having a second part which is fastened into the cylinder and the second part is bent at an angle with respect to the first part.

* * * * *